US005990631A

United States Patent [19]

Hioki et al.

[11] Patent Number: 5,990,631

[45] Date of Patent: Nov. 23, 1999

[54] STROBOSCOPE CIRCUIT CONTROLLING DIMMER OPERATION

[75] Inventors: Tatsuya Hioki; Keizo Sekido, both of Hadano, Japan

[73] Assignee: Stanley Electric Co., Ltd., Tokyo, Japan

[21] Appl. No.: 09/033,414

[22] Filed: Mar. 2, 1998

[30] Foreign Application Priority Data

Mar. 4, 1997 [JP] Japan ..... 9-049189

[51] Int. Cl.[6] ..... H05B 37/00

[52] U.S. Cl. ..... 315/241 P; 315/241 S; 396/205; 396/206

[58] Field of Search ..... 315/241 P, 241 S, 315/DIG. 4, 245, 240, 241 R, 227 R; 396/156, 159, 205, 206

[56] References Cited

U.S. PATENT DOCUMENTS 4,951,081 8/1990 Hosomizu et al. .
5,159,381 10/1992 Harrison .
5,661,372 8/1997 Ishimaru et al. .

*Primary Examiner*—David H. Vu
*Attorney, Agent, or Firm*—James Creighton Wray; Meera P. Narasimhan

[57] ABSTRACT

In a current cut-off type automated stroboscope circuit which controls a flashlight intensity by cutting off the current flowing through a flash lamp, a high-speed semiconductor switching device inserted in series with respect to the stroboscopic tube has been encountered up to now with malfunction and breakdown problems induced by chattering. To solve aforesaid problems, the present invention is to provide a xenon tube 1 with an IGBT 2 connected in series with respect to the xenon tube 1. The gate electrode of the IGBT is connected to two pnp-type transistors Q1 and Q2 substantially inbetween, both transistors of which are connected in series with respect to each other. The IGBT is controlled by turning on and turning off of the transistors Q1 and Q2. Furthermore, a time constant circuit which is formed of a capacitor C1 and a resistor R1 is connected to the transistor Q1. A gate voltage is applied to the IGBT 2 only for a certain period of time (one shot) which is defined by a time constant of CR product.

3 Claims, 2 Drawing Sheets

STROBOSCOPE CIRCUIT CONTROLLING DIMMER OPERATION

BACKGROUND OF THE INVENTION

1. Field of the Invention

The present invention relates mainly to a stroboscope circuit capable of controlling a dimmer operation of an electronic flashlight and, more particularly, to a series-type automated stroboscope dimmer circuit which cuts off a current flowing through a flash lamp when an intensity of an exposure light reaches a predetermined value.

2. Brief Description of the Prior Art

A circuit, for instance, shown in FIG. 3 has been proposed up to now as an electric current cut-off type automated stroboscope dimmer circuit.

In FIG. 3, a numeric character 1 stands for an electronic flash lamp, for instance, a xenon tube while 2 stands for an insulated gate bipolar transistor (referred to as "IGBT" hereinafter) which is connected in series with respect to the xenon tube 1. Q1 and Q2 are pnp-type transistors which are connected in series to each other. A gate electrode of the IGBT 2 is connected to an emitter-sided electrode of the transistor Q2 and substantially connected also to a collector electrode of the transistor Q1. On the other hand, a base electrode of the transistor Q1 is connected to a collector-sided electrode of a pnp-type transistor Q3.

Another numeric sign 3 stands for a dimmer circuit, 4 stands for a power supply terminal for receiving a driving voltage to be supplied to the xenon tube 1, 5 stands for an input terminal for receiving a control voltage signal VB and 6 stands for another input terminal for receiving a synchronous signal (a timing signal) SY. Herein R2 to R4, R6 and R8 to R10 stand for resistors, respectively.

Aforesaid circuit employs the IGBT 2 as a switching device which cuts off the current. When the flashlight illuminated from the discharging xenon tube 1 extends to a certain intensity, a dimmer action is performed by switching the IGBT 2 from a conductive status to a cut-off status thereby stopping the current flowing through the xenon tube 1.

Namely, when the synchronous signal SY is switched from an H (high level) status to an L (low level) status first, the transistor Q1 turns on and the control signal voltage (the gate voltage) VB is applied to the gate electrode of the IGBT 2. Accordingly, the IGBT 2 turns on to fire the xenon tube 1, by which a flashlight illumination is initiated.

When the intensity of the flashlight emitted from the xenon lamp 1 reaches a desired value, an output signal A transmitted from the dimmer circuit 3 turns from an H status into an L status, which turns on the transistor Q2. The turning on of the transistor Q2 turns off the IGBT 2 as well as turns the transistor Q3 into a conductive status, the latter of which turns off the transistor Q1 on the contrary. As a result, the gate voltage supplied to a gate electrode of the IGBT 2 is terminated.

In such an automated stroboscope circuit as mentioned above, the transistors Q2 and Q3 are simultaneously turned on to turn off transistor Q1 during dimmer operation. However, such a circuit configuration is apt to induce some chattering phenomena in switching operation, which encounters with a big problem that causes sometimes fatal breakdowns in the IGBT 2.

On the other hand, aforesaid circuit configuration requires simultaneously three pieces of transistors, which proposes another problem that the circuit requires many pieces of expensive electronic components called semiconductor devices.

SUMMARY OF THE INVENTION

The present invention is carried out to solve aforesaid problems. An object of the present invention is to provide an automated stroboscope dimmer circuit capable of preventing malfunctions of the circuit and the permanent breakdown of a switching device which have been induced by the chatterings.

Another object of the invention is to provide the automated stroboscope dimmer circuit of which manufacturing cost is reducible by reduction in part number of semiconductor devices in use for controlling the circuit.

To satisfy the purposes mentioned above, the present invention provides an automated stroboscope circuit, wherein:

a stroboscopic dimmer operation is performed by switching of a switching device connected in series with respect to an electronic flash lamp, comprising:

two transistors electrically connected in series with respect to each other;

a gate electrode of the switching device connected to the two transistors substantially inbetween, constitution of which makes the two transistor serve for controlling the switching operation of the switching device; and a time constant circuit for applying an gate voltage signal for certain period of time during the turning on status of the switching device.

Herein, the invention is also to provide another configuration wherein the switching device is an IGBT as well as still another configuration wherein the circuit having the certain time constant is formed of a capacitor and a resistor.

DETAILED DESCRIPTION OF THE PREFERRED EMBODIMENTS

Hereinafter are detailed the preferred modes during carrying out the present invention into practice with reference to the drawings. The best mode will also be described corresponding to the preferred embodiments.

Figure 1:
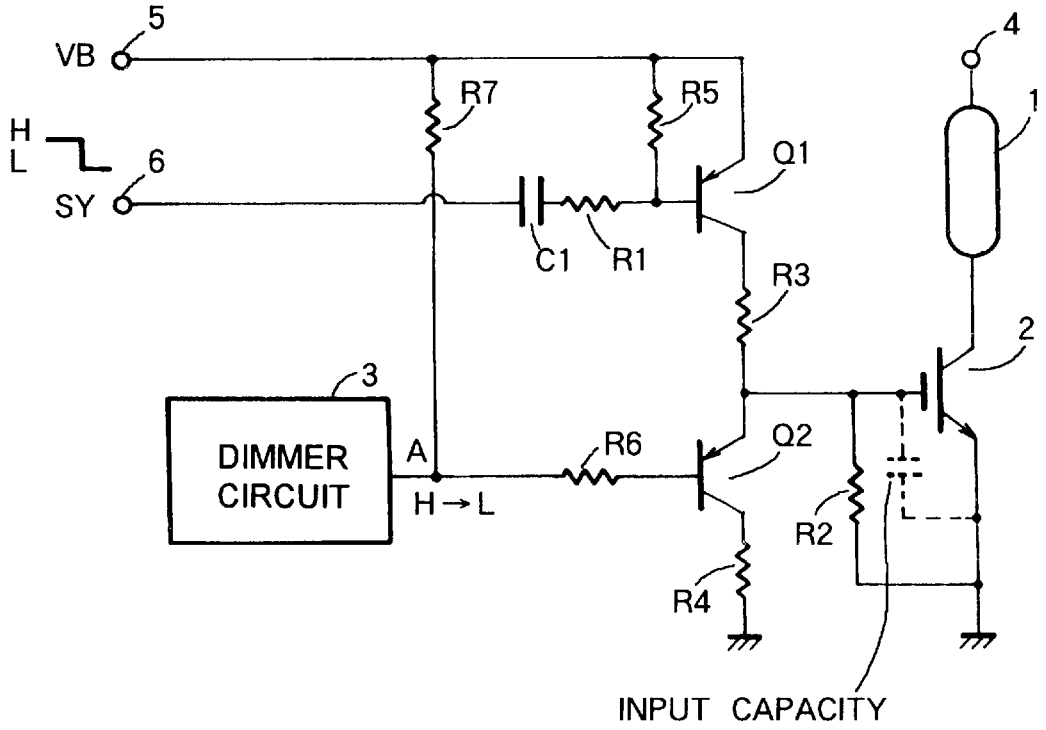
FIG. 1 is a circuit diagram of an embodiment according to the present invention.
Figure 3:
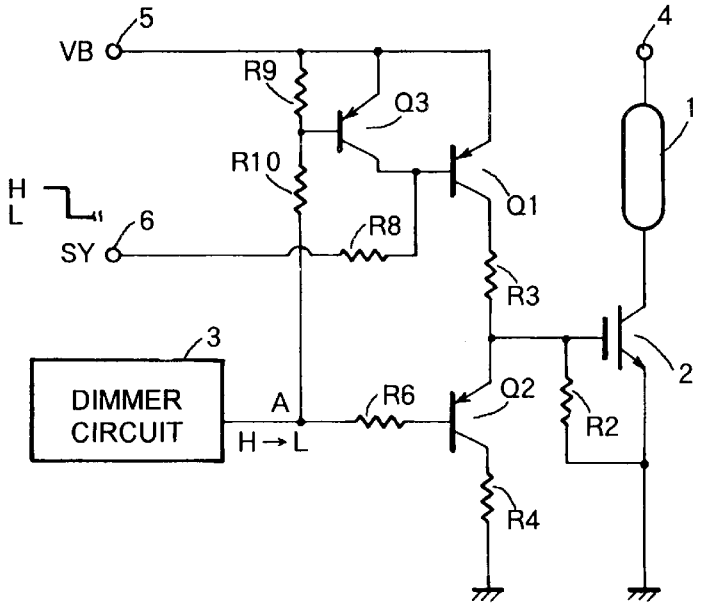
FIG.3 (PRIOR ART)
FIG. 3 (PRIOR ART) is a circuit diagram of a conventional automated stroboscope dimmer circuit.

FIG. 1 is a series-type automated stroboscope circuit according to the present invention which controls a flashlight illumination intensity by cutting off a current flowing through a stroboscopic tube. Herein the same signs as shown in FIG. 3 indicate the same constituents as shown in FIG. 3.

In FIG. 1, 1 stands for an electronic flash lamp called a stroboscopic lamp: namely, a xenon tube, 2 stands for an IGBT used as a high-speed switching device which is connected in series with respect to this xenon tube 1. A gate electrode of the IGBT 2 is interconnected to two transistors Q1 and Q2 substantially inbetween, both transistors of which are connected in series with respect to each other.

A numeric character 3 stands for a dimmer circuit, 4 stands for a power supply terminal for receiving an electric power to be supplied to the xenon tube 1, 5 stands for an input signal terminal for receiving a control signal (a gate voltage) VB of the IGBT 2 and 6 stands for another input signal terminal for receiving a synchronous signal (a timing signal) SY.

On the other hand, C1 and R1 are a capacitor and a resistor which are connected in series with respect to each other, respectively. This series circuit works as a time constant circuit which supplies a gate voltage for a certain period of time to the gate electrode during the ON-status of the IGBT 2. The duration of the period of time when the voltage signal is applied to the gate electrode of the IGBT 2 is for one shot which is decided by the time constant of a CR product (capacity C multiplied by resistivity R). From R2 to R7 stand for resistors in use for limiting currents.

The circuit constituted mentioned above is an automated stroboscope circuit for dimming an illumination in use for a film camera utilizing IGBT 2 similarly to FIG. 3. When the flashlight illumination projected from the discharging tube reaches a desired intensity after a discharge of the xenon tube 1 is fired, it turns IGBT 2 from the conductive status to the cut-off status to block a driving current flowing through the xenon tube 1.

Namely, when the synchronous signal SY is switched from an H status to an L status, the transistor Q1 is turned on and a control voltage signal VB is applied to the gate electrode of IGBT 2 for the certain period of time which is defined by the time constant of the CR product (capacity of the capacitor C1 multiplied by resistivity of the resistor R1). This gate voltage turns on the IGBT 2. When the flashlight illumination rises to the specified intensity after the xenon tube 1 is initiated to flash, an output signal A propagated from a dimmer circuit 3 turns from the H level to the L level, which turns on the transistor Q2 to convert a gate potential of the IGBT 2 from the H level to the L level. This conversion of the gate potential turns off the IGBT 2 to block the driving current flowing through the xenon firing lamp 1, which terminates the flashlight illumination.

Figure 2:
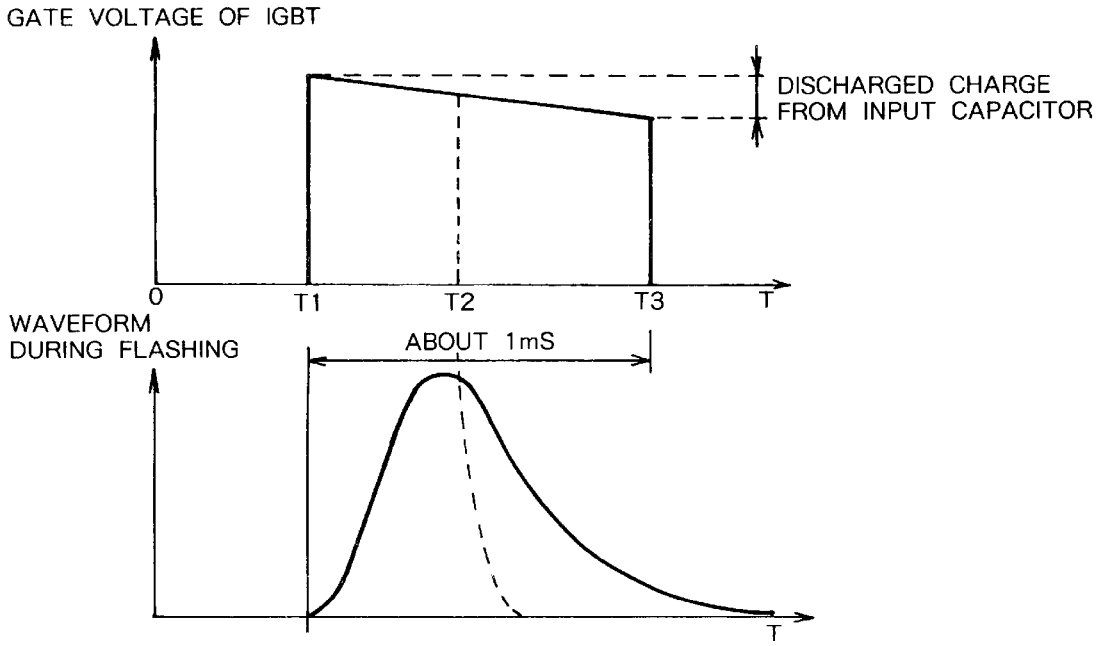
FIG. 2 is a graph for illustrating a time dependence of gate voltage in an IGBT and a flashlight intensity waveform in FIG. 1.

FIG. 2 shows a time dependence of the IGBT gate potential and a flashlight waveform of the xenon flash lamp 1. Herein each abscissa indicates an elapsing time T. When the gate voltage is applied to the gate electrode of IGBT 2 at a time T1, the xenon discharge tube 1 begins to flash. When an intensity of the flashlight reaches the desired level at another time T2, the dimmer operation is performed. Actually, the gate voltage of IGBT 2 is lowered as a vertical broken line shown in the figure and the flashlight illumination is terminated. When the dimmer operation is not performed, the gate voltage is continuously supplied to IGBT 2 till a still another time T3, which carries out a full flashing.

It takes about 1 millisecond (referred as to "ms") from T1 to T3 mentioned above. Incidentally, the gate voltage of IGBT 2 is lowered a little, depending on an electric charge quantity lost by discharging through an input capacity.

Because the circuit according to the present invention supplies the gate voltage for one shot which is decided by the time constant of the CR circuit attached to the transistor Q1, not only the malfunction of the switching circuit but also the breakdown of the IGBT 2 as the switching device, both of which are induced by the chatterings when the dimmer circuit 3 works to turn off the IGBT 2, can be prevented. Simultaneously, the expensive semiconductor devices used in the circuit are also reducible to be only two transistors Q1 and Q2.

As mentioned above, because the stroboscope dimmer circuit according to the present invention is constituted so as to apply the gate voltage signal to the switching device for a certain period of time, it can prevent the breakdown and the malfunction of the switching device which would be induced by the chattering as well as can reduce a number of transistors in use for the circuit control.

What is claimed is:

1. An automated stroboscope circuit, wherein:

a stroboscopic dimmer operation is performed by switching a switching device connected in series with respect to an electronic flash lamp, comprising:

two transistors connected electrically in series with respect to each other;

a gate electrode of said switching device connected to said two transistors substantially in between, a constitution of which makes said two transistors serve for controlling the switching operations of said switching device; and a time constant circuit for applying a gate voltage signal for certain period of time during the turning on status of said switching device.

2. The stroboscope circuit according to claim 1, wherein said switching device is an IGBT.

3. The stroboscope circuit according to claim 1, wherein said time constant circuit is composed of a capacitor and a resistor.

* * * * *